United States Patent [19]

Cleaveland et al.

[11] 4,339,636

[45] Jul. 13, 1982

[54] DISCONNECTING SWITCH HAVING IMPROVED SWITCH-BLADE HINGING STRUCTURE

[75] Inventors: Charles M. Cleaveland, N. Huntingdon; Peter M. Kowalik, Trafford, both of Pa.

[73] Assignee: Cleaveland/Price Enterprises, Inc., Trafford, Pa.

[21] Appl. No.: 219,883

[22] Filed: Dec. 24, 1980

[51] Int. Cl.[3] ..... H01H 31/00

[52] U.S. Cl. ..... 200/48 A; 308/21; 403/57

[58] Field of Search ..... 200/48 R, 48 KB, 48 A; 308/21; 403/58, 57, 116, 117

[56] References Cited

U.S. PATENT DOCUMENTS

| | | | |
|---|---|---|---|
| 2,328,283 | 8/1943 | Koppitz et al. | 200/48 A |
| 3,186,736 | 6/1965 | Warshawsky | 403/117 |
| 3,259,704 | 7/1966 | Turgeon | 200/48 A |
| 3,500,006 | 3/1970 | Kuhn | 200/48 A |
| 3,566,056 | 2/1971 | Joseph | 200/48 R |
| 3,875,355 | 4/1975 | Frink et al. | 200/48 A |

*Primary Examiner*—John W. Shepperd

*Attorney, Agent, or Firm*—Willard R. Crout

[57] ABSTRACT

An improved disconnecting switch is provided having an improved hinging structure which provides the traditional movements of a vertical break disconnect switch-blade in a simple and unique way. The switch-blade rotates about its longitudinal axis on a blade plug which is supported by a hinge pin that passes at a right angle through slots provided in the blade and a hole in the blade plug. The slots define the amount of rotation and prevent the switch-blade from sliding along the longitudinal axis. The structure also allows the switch-blade to pivot open on the axis of the hinge pin. The switch-blade contact on the hinge end of the switch may be used as the supporting member for the hinge pin.

8 Claims, 8 Drawing Figures

DISCONNECTING SWITCH HAVING IMPROVED SWITCH-BLADE HINGING STRUCTURE

BACKGROUND OF THE INVENTION

1. Field of the Invention

The present invention relates to high-voltage disconnecting switches and more particularly to an improved hinging arrangement for the switch-blade to initially cause it to rotate longitudinally and subsequently to cause it to swing upward away from its cooperable stationary contact assembly.

2. Description of the Prior Art

Prior art switches have been supplied with remote adjustments which are unable to accurately supply the required contact pressure at the switch contacts.

Additionally, they have had expensive and complicated hinging structures for the switch-blade.

SUMMARY OF THE INVENTION

The present invention relates to the hinging structure adjacent the hinge end of the swinging switch-blade, which electrically interconnects the two stationary switch-contact assemblies of a disconnecting switch. As well known by those skilled in the art, a disconnecting switch is preferably provided in series with circuit-breakers, or other line-controlling devices, so as to ensure an open, visible, disconnecting gap when the disconnecting switch is opened. By the maintenance personnel being able to observe the open, visible, disconnecting gap, they are assured of the safety necessary when providing maintenance operations upon the associated transmission-line equipment.

A general object of the present invention is to provide a novel, simplified, mechanical hinge arrangement for a disconnecting switch-blade, that will allow both rotary motion of the switch-blade and also a pivoting motion to raise the switch-blade, all about a blade plug and hinge pin.

An additional object of the present invention is to provide an improved hinging structure of the foregoing type in which the hinging member may also serve as the blade contact on the hinge-end of the switch.

Still a further object of the present invention is the provision of an improved hinging structure for a disconnecting switch-blade in which a slotted hole is provided adjacent the hinge end of the switch-blade, and the rotary motion about the longitudinal axis of the switch-blade is stopped by the end of the aforesaid slotted hole provided in the switch-blade as it engages with the stationary hinge pin. This assures that the switch-blade stops at the point of maximum contact pressure provided within the break jaw contact assembly. Furthermore, the sides of the slot engage with the flat sides of the hinge pin to prevent the blade from moving axially along the longitudinal axis of the blade.

Still a further object of the present invention is to provide an improved hinging structure for the hinge end of a disconnecting switch-blade in which use is made of the hinge-end contact jaw as the supporting member for the hinge pin. Preferably, the hinge jaw is of the reverse-loop-type for good electrical contact during the existence of short-circuit conditions. Contact springs may optionally additionally be provided, if desired.

In accordance with the present invention, there is provided an improved disconnecting switch structure having an improved hinge structure having a blade-plug inserted within the hinging end of a movable tubular disconnecting switch-blade, the latter being provided with a slotted hinge hole therethrough. A stationary hinge pin passes through both the slotted hinge opening of the switch-blade and also through the hole provided in the blade-plug, the latter, as mentioned, being surrounded by the tubular switch-blade, and the switch-blade being rotatably movable with respect to the blade plug which acts as a bearing for the tubular switch-blade to rotate about.

A further improvement of the novel hinging structure of the present invention is the provision of the stationary hinge jaw contact providing a stationary support for the hinge pin, the latter preferably passing through the stationary furcations of the generally "U"-shaped stationary switch contact assembly. As an auxiliary feature, when desired, compression springs may surround the stationary hinge pin, being disposed between the reverse-bend portion and the other furcations of the generally "U"-shaped stationary hinge-end jaw contact.

DESCRIPTION OF THE PREFERRED EMBODIMENTS

Figure 1:
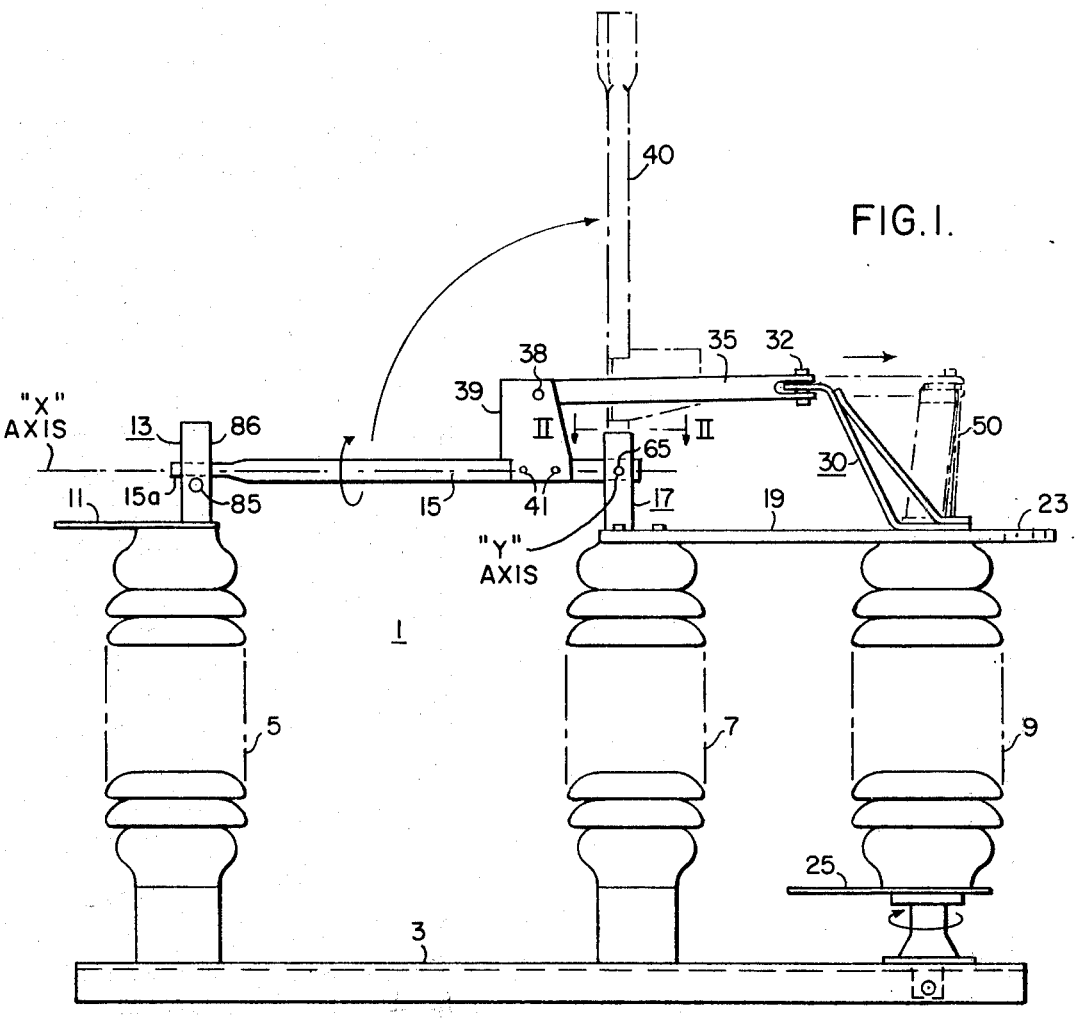
FIG. 1 is a side elevational view of a disconnecting switch structure embodying features of the present invention, the movable switch blade being illustrated in the closed-circuit position.

Referring to the drawings, and more particularly to FIG. 1 thereof, the reference numeral 1 generally designates a disconnecting switch structure having a base portion 3 of generally inverted channel-shaped construction, and having supported upwardly therefrom, three post-type insulators 5, 7 and 9. At the upper end of the left-hand post insulator 5 is a line-terminal connection 11 and a break jaw contact assembly 13. Making electrical contacting engagement with the break jaw contact assembly 13 is a switch-blade 15, the latter being pivotally mounted about a hinge jaw contact assembly 17, the details of which are more readily apparent from an inspection of FIG. 3 of the drawings.

As illustrated in FIG. 1, the middle post insulator support 7 assists in supporting at its upper end the hinge jaw contact assembly 17 and also a strap-like conductor 19, the latter extending across the outer, rotatable post insulator 9, and having its right-hand end form a second line-terminal connection 23 for the disconnecting switch structure 1.

Figure 8:
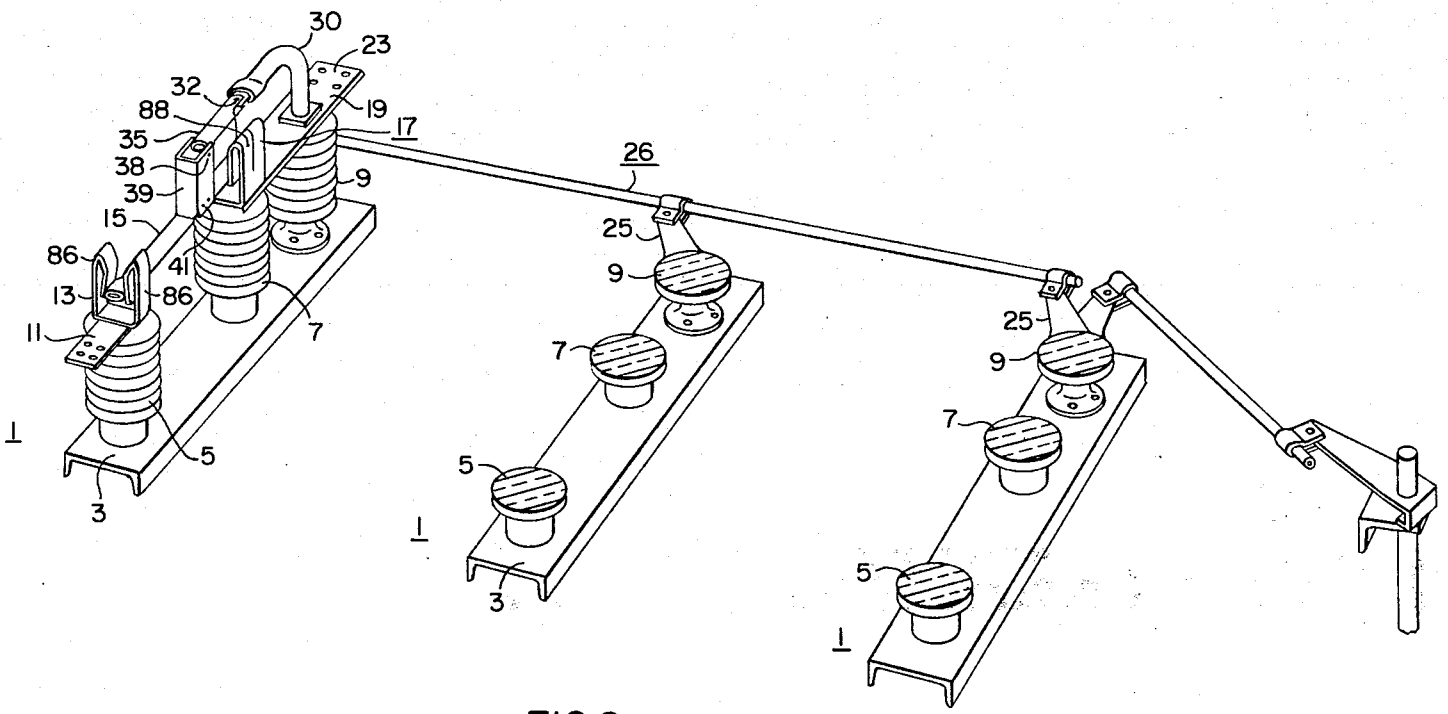

To effect the rotatable operating movement of the rotatable post insulator 9, there is provided a crank-arm 25, which may be rotated by any suitable operating means 26 illustrated more clearly in FIG. 8 of the drawings. Rotation of the crank-arm 25 will effect corresponding rotation of the rotatable post insulator 9 and thus also rotative action of an operating-arm structure 30, the operating arm structure 30 pivotally connected by a pivot pin 32 to a floating link 35, the left-hand end of which being pivotally connected, by a pivot pin 38, to a generally "U"-shaped operating member 39, which is fixedly secured, as by a pair of bolts 41 adjacent the right-hand end of the disconnecting switch-blade 15.

With reference to FIG. 1, it will be observed that in the open-circuit position of the disconnecting switch 1, the movable switch-blade 15 moves to the dotted position 40, and the linkage, comprising the link 35 and operating arm structure 39, moves to the dotted position 50 of FIG. 1.

Figure 2:
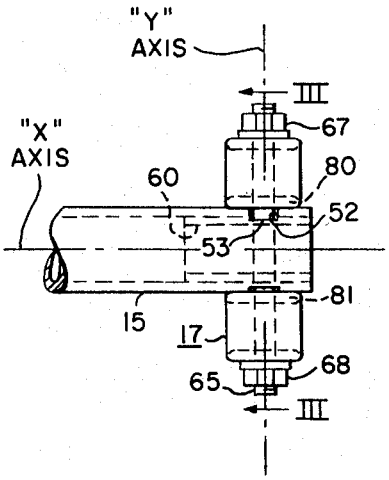
FIG. 2 is a fragmentary view taken substantially along the line II—II of FIG. 1 looking in the direction of the arrows.
Figure 3:
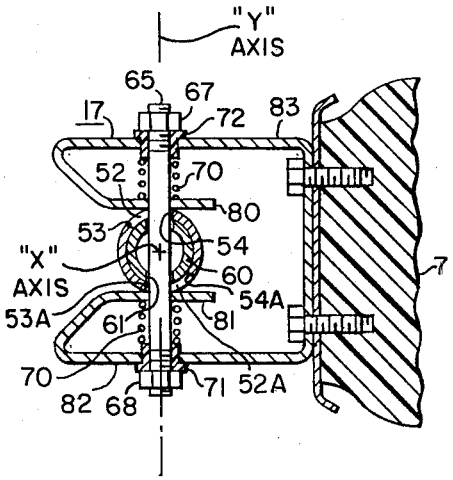
FIG. 3 is a fragmentary vertical sectional view taken substantially along the line III—III of FIG. 2 looking in the direction of the arrows.
Figure 5:
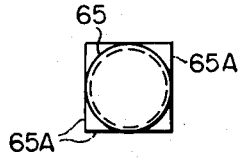
FIG. 5 is an end view of the hinge pin of FIG. 4.

With particular reference being directed to FIGS. 2 and 3 of the drawings, it will be observed that the right-hand end of the disconnecting switch-blade 15, which is preferably of tubular construction, is provided with thru-slotted hinge openings 52, 52A having ends 53 and 54 on one side of the tube 15 and ends 53A and 54A on the other side, as more clearly shown in FIG. 3 of the drawings. In addition, a tubular blade-plug 60 is inserted within the right-hand end of the tubular disconnecting switch-blade 15, and this blade-plug 60 has a hinge hole 61 provided therethrough to accommodate a stationary hinge pin 65 having its outer ends threaded to accommodate nuts 67 and 68. As shown more clearly in FIG. 4, the central portion of the hinge pin 65 is square to provide flat surfaces 65A to mate with the sides of the two slots 52, 52A in the switch-blade 15. A pair of compression springs 70 surround the ends of the hinge pin 65 and are interposed between insulating bearings 71 and 72, and force the inner contact end portions 80, 81 of the stationary contact assembly 17 into good contacting engagement with the outer surface of the tubular disconnecting switch-blade 15, all as shown more clearly in FIG. 3 of the drawing.

As well known by those skilled in the art, a typical vertical break disconnecting switch 1 employs a rotating insulator such as the insulator 9, which operates a mechanism first to turn the swinging movable switch-blade within the break jaw contact assembly thereby releasing contact pressure therebetween, or aiding in breaking any ice formation thereat, and, secondly, to raise the disconnecting switch-blade vertically to provide an open isolating visible gap. The present invention specifically relates to a simplified mechanical hinging arrangement, that allows both rotary motion of the disconnecting switch-blade 15, and also a pivoting motion thereof to raise the disconnecting switch-blade 15 all about the same stationary hinge pin 65. An important feature of the instant invention is also that the hinging contact member 17 may additionally serve as the hinge-end stationary contact assembly for the inner end of the switch-blade 15.

The disconnecting switch structure 1 of the present invention is opened for the closed-circuit position, as illustrated in FIG. 1 by the solid lines, to the open-circuit position, shown by the dotted lines 40, 50, by rotating the rear insulator support 9. The first twenty degrees of insulator rotation causes the disconnecting switch-blade 15 to rotate about the longitudinal axis "X" of the disconnecting switch-blade 15 within the constraints 53, 54, 53A, 54A of the slotted holes 52, 52A provided adjacent the hinge end of the tubular disconnecting switch-blade 15. This rotation of the switch-blade 15 about its longitudinal axis "X" releases the contact pressure on the outer break jaw assembly 13 as the flat portion **15*a* of the disconnecting switch-blade 15 turns out of the stationary jaw contact assembly 13. Continued rotation of the rotatable post-like insulator 9 (80°), now causes the disconnecting switch-blade 15 to pivot about the transverse axis "Y" of the disconnecting switch structure 1 to thereby raise the disconnecting switch-blade 15 from a horizontal closed position, as illustrated in the full lines of FIG. 1, to a vertical, fully-opened-circuit position, as illustrated by the dotted lines 40 in FIG. 1, thereby providing an open air gap between the spaced disconnecting switch-contact assemblies 13 and 17**.

The disconnecting switch structure 1 is closed by reversing the rotation direction of the rotatable insulator 9. The first 80° lowers the disconnecting switch-blade 15, which pivots about the transverse axis "Y" until it eventually stops on the jaw spacer 85, as illustrated in FIG. 1. The final 20° of insulator rotation causes a rotary movement of the disconnecting switch-blade 15 around its longitudinal axis "X", thereby turning the flat portion **15*a* of the disconnecting switch-blade 15 into the stationary break jaw contacts 86 of the stationary break jaw contact assembly 13. The rotary motion along the "X" axis is stopped by the end 54 of the slotted hole 52 provided adjacent the hinge end of the switch-blade 15. This assures that the disconnecting switch-blade 15 stops at the point of maximum contact pressure within the furcations, or contact fingers 86 of the stationary break jaw assembly 13 of FIG. 1. There is a further advantage of this arrangement, since other disconnecting switches of the prior art have the stops for the switch-blade rotation on the axis of the rotating insulator, which is too remote from the disconnecting switch-blade 15 to accurately stop all three phases of the disconnecting switch 1, such as shown in FIG. 8, without interphase linkage adjustments. With the improved disconnecting switch structure 1 of the present invention, the "play" in the pins and links in each phase (FIG. 8) has no bearing on the final disconnect-blade position, since the stop is on the disconnecting switch-blade 15 itself, and therefore the improved structure can accurately stop all three blades of a three-phase disconnecting switch, as shown in FIG. 8**.

It will be observed that the disconnecting switch-blade 15 rotates upon the outer diameter of the blade-plug 60 on the "X" axis with its travel defined by the ends 53, 54, 53A, and 54A of the two slots 52 and 52A provided adjacent the hinge end of the disconnecting switch-blade 15. On the "Y" axis, the disconnecting switch-blade 15 pivots together with the hinge pin 65 on the bearings 71 and 72 (FIG. 3) using the sides of the hinge slots 52, 52A to axially locate the disconnecting switch-blade 15 relative to the hinge pin 65. Herein lies the simplicity of the instant invention in that the hinge pin 65 passes through the switch-blade 15. Other designs of the prior art have distinctly separated the "X" and "Y" axis bearings, resulting in a much more expensive and elaborate switch construction.

A further important feature of the present invention is the use of the hinge-end stationary contact jaw assembly 17 as the supporting member for the hinge pin 65. Preferably, the stationary hinge jaw contact assembly 17 should be of the reverse-loop type for best electrical contact during short-circuit conditions. The compression springs 70 apply pressure to the inner spaced contacts 80 and 81 (FIG. 3) and are isolated from the electrical current path by the insulated bearings 71, 72. It is obvious that any current flow through the compression springs 70 would tend to heat them and so affect their temper.

Figure 4:
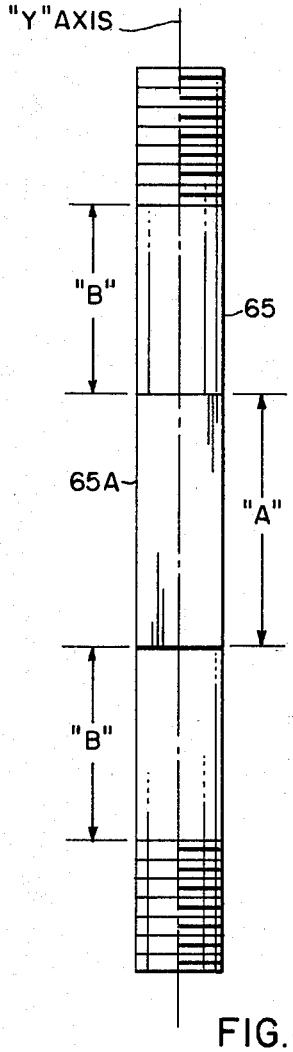
FIG. 4 is a detail view of the hinge pin itself showing the square portion thereof in the center of the hinge pin.

FIG. 4 shows more clearly the hinge pin 65 having flat surfaces 65A which bear against the sides of the slotted hinge holes 52, 52A of the switch-blade 15 to prevent axial movement of the switch-blade on the longitudinal "X" axis. These flat surfaces 65A provide a larger bearing area to thus handle greater axial loads on larger and heavier switch-blades 15, then would a round or hexagon hinge pin. The flat-to-flat surfaces 65A have, of course, better bearing wear resistance than a flat-to-round surface. The square portion 65A of the hinge pin 65 is long enough in the dimension "A" of FIG. 4 to fit across the diameter of the blade 15 and the remaining lengths "B" of the pin 65 are round on both ends of the pivot pin 65 to fit into the two outer insulating bearings 71, 72 (FIG. 3).

Figure 6:
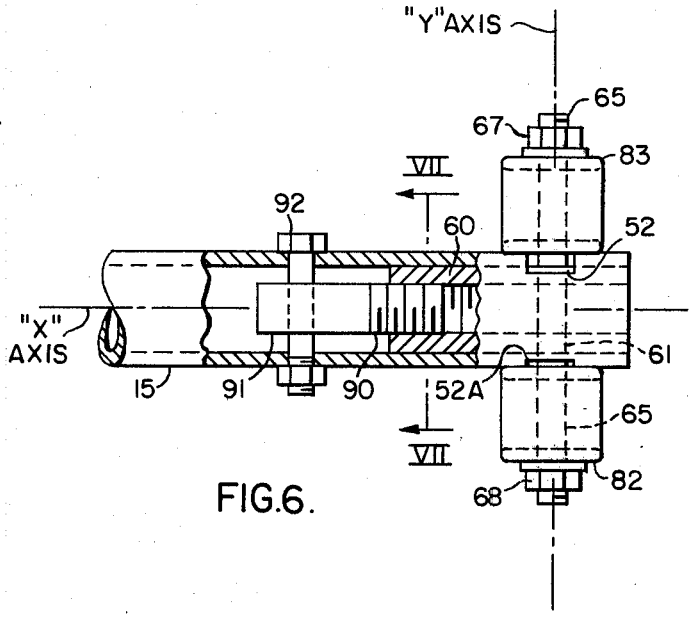
FIG. 6 is a fragmentary enlarged view of a modified type of hinging structure.

For larger and heavier switch-blades 15 the axial thurst of the blade 15 on the "X" axis may exceed the bearing capacity of the slotted hole 52, 52A as it pushes against the hinge pin 65, even with a square hinge pin 65. This situation may be improved by an alternate method of retaining the blade 15 axially on the "X" axis as shown in FIG. 6 wherein the axial thrust from the blade 15 is transferred via bolt 92 and shaft 92 to the blade plug 60 which transfers the thrust to the hinge pin 65 at the hole 61. A rotative connection 90, such as threads or thrust bearings between the blade plug 60 and a shaft 91 allows the blade 15 to rotate on the "X" axis. The blade still pivots on the "Y" axis as described earlier.

Figure 7:
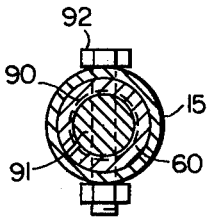
FIG. 7 is a sectional view of the hinging modification of FIG. 6 taken along the line VII—VII of FIG. 6 looking in the direction of the arrows; and, FIG. 8 somewhat diagrammatically illustrates a three-phase disconnecting switch assembly with the contacts in the end phase being shown closed.

FIG. 7 is an end view of FIG. 6, and as shown in detail in FIGS. 6 and 7, a shaft 91 is connected to the blade 15 by a bolt 92. As the blade 15 rotates on the "X" axis, the shaft 91 turns in the rotative connection 90. The rotative connection 90 between the blade 15 and blade plug 60 can be accomplished in several ways without departing from the spirit of the invention.

From the foregoing description, it will be apparent that there has been provided an improved hinging structure 17 for the disconnecting switch-blade 15 of a disconnecting switch 1 of simplified construction, which provides for a defined switch-blade travel about the "X" and "Y" axes and combines the electrical contact with the hinge supporting function.

As shown in FIG. 8, for the higher-current ratings, the stationary hinge contact assembly 17A may include additional inner finger contact portions 88 in addition to the "pivot" contact fingers 80 and 81 as heretofore described. The functioning of the switch is the same as described above.

Although there have been illustrated and described specific structures, it is to be clearly understood that the same were merely for the purpose of illustration, and that changes and modifications may readily be made therein by those skilled in the art, without departing from the spirit and scope of the invention.

I claim:

1. A disconnecting switch structure comprising a pair of spaced stationary first and second switch contact assemblies (13, 17), means defining an elongated pivotal conducting switch-blade (15) having a first end stationarily hinged adjacent the first spaced stationary switch contact assembly (17) for pivotal motion thereabout and having its other free end available for swinging pivotal motion into and out of contacting engagement with the second spaced stationary switch contact assembly (13), said first end of the pivotal switch-blade (15) having a slotted hole (52) provided therein, including a switch blade-plug (60) having a hole (61) provided therein, inserted within the hinging end of the disconnecting switch-blade (15), means defining a hinge pin (65) located adjacent the first switch contact assembly (17) and passing through both the slotted hole (52) of the switch-blade and also through the hole (61) of said inserted switch blade-plug (60), operating means for causing pivotal swinging motion of the elongated switch-blade (15) about said hinge means (17), whereby during the initial opening motion of the disconnecting switch there first occurs rotative motion of the switch-blade (15) about the longitudinal "X" axis, with the switch-blade rotatively sliding upon the blade plug (60) and with the switch-blade being axially retained along the longitudinal "X" axis by the sides of the slotted holes (52) in the switch-blade bearing against the hinge pin (65), and during the final opening motion of the disconnecting switch the switch-blade (15), transverse blade-plug (60) and hinge pin (65) pivot on the transverse "Y" axis causing the outer free end of the disconnecting switch-blade (15) to separate from the second switch contact assembly (13) thereby providing an open-circuit, visible disconnecting gap therebetween.

2. The disconnecting switch structure of claim 1, wherein the first spaced stationary switch contact assembly (17) comprises a generally "U" shaped contact member, and the stationary hinge pin (65) passes through and is supported by the furcation portions (80, 81) of the generally "U" shaped stationary first switch contact assembly (17).

3. The combination according to claim 1, wherein the generally "U"-shaped stationary first contact assembly (17) has a pair of confronting reverse-bend portions (80, 81) associated with the bight portion thereof, and the stationary hinge pin (65) passes through the reverse-bend portions and is supported by the bight portion.

4. The combination according to claim 1, wherein a pair of compression springs (70, 71) surround the hinge pin (65) and are interposed between the bight portions (82, 83) of the switch contact assembly (17) and the reverse-bend portions (80, 81) thereof for providing increased contacting force between the reverse-bend portions (80, 81) and the outer sides of the disconnecting switch-blade (15) by reacting against the shoulder ends of the hinge pin.

5. The combination according to claim 1, wherein multiple "U"-shaped contact members are utilized to improve the electrical current carrying capacity of the switch but only one "U"-shaped member having the hinge pin passing through it for hinging purposes.

6. The combination according to claim 1, wherein the ends of the slotted hinge hole (52), engaging with the hinge pin (65), limit the rotative travel of the switch-blade (15) about the longitudinal "X" axis.

7. The combination according to claim 1, wherein the hinge pin (65) has flat sides (65A) providing bearing surfaces to engage with the sides of the slotted hole (52) of the blade.

8. The disconnecting switch structure of claim 1, wherein the switch-blade (15) is axially retained along the longitudinal "X" axis by a rotative connection (90) between the blade plug (60) and blade thereby transferring the axial thrust from the blase (15) to the hinge pin (65) via the blade plug (60).

* * * * *